United States Patent [19]

Harbord

[11] 4,123,198

[45] Oct. 31, 1978

[54] PROPELLER

[76] Inventor: Horace R. Harbord, 5a Avenida Norte #34, Mexicanos, El Salvador

[21] Appl. No.: 781,629

[22] Filed: Mar. 28, 1977

[51] Int. Cl.[2] ..... F04D 29/38

[52] U.S. Cl. ..... 416/243; 416/223 R

[58] Field of Search ..... 416/243, 223 R, 210 R, 416/214 R, 244 R, 245 R

[56] References Cited

U.S. PATENT DOCUMENTS

| | | | |
|---|---|---|---|
| 1,512,545 | 10/1924 | Kaplan | 416/223 |
| 2,336,303 | 12/1943 | Schubert | 416/243 |
| 2,524,870 | 10/1950 | Adamtchik | 416/243 |
| 3,332,500 | 7/1967 | Bristol et al. | 416/243 |
| 4,040,769 | 8/1977 | Britz | 416/213 A |

FOREIGN PATENT DOCUMENTS

| | | | |
|---|---|---|---|
| 225,195 | 7/1958 | Australia | 416/DIG. 3 |
| 153,111 | 1/1956 | Sweden | 416/223 |
| 276,510 | 10/1951 | Switzerland | 416/214 |
| 225,811 | 5/1925 | United Kingdom | 416/223 |
| 558,612 | 1/1944 | United Kingdom | 416/223 |
| 574,239 | 1/1946 | United Kingdom | 416/223 |

*Primary Examiner*—Everette A. Powell, Jr.
*Attorney, Agent, or Firm*—Ralph B. Pastoriza

[57] ABSTRACT

The propeller includes a central hub with a plurality of blades extending radially from equal circumferentially spaced points on the periphery of the hub. The width of each blade at its root is equal to the spacing between adjacent blades and the width of each blade at its tip is equal to one half the width of its root. The leading edge of each blade is normal to a line tangential to the point of connection of the blade to the hub periphery while the trailing edge slants from the tip to the broader root. The length of each blade is one half the diameter of the hub and each blade has an angle of attack of about 17°. This structural dimensioning results in a propeller providing a substantially constant air discharge from the roots to the tips of the blades with a substantial elimination of radial air flow, all to the end that a greater static thrust can be realized for a given horsepower input.

4 Claims, 3 Drawing Figures

PROPELLER

This invention relates to propellers or fans of the axial flow type particularly useful for propelling aircraft, boats and the like.

BACKGROUND OF THE INVENTION

The design of propellers for powering aircraft and boats and the like and for use as axial flow propeller fans has become quite sophisticated with complex aerodynamic shapes being devised for the blades used on such propellers. Theory and practical aspects of such designs may be found, for example, in *Marks' Mechanical Engineers Handbook*, by McGraw-Hill Book Co., Inc. 6th Edition, at pp. 11-105 to 11-115 and pp. 14-66 to 14-76.

As set forth in the foregoing handbook at p. 11-109, static thrust produced by the usual propeller, per horsepower input to the propeller, is usually in the range of 3 to 4 pounds and is seldom if ever over about 5 pounds. It is apparent, accordingly, that a propeller which could produce a substantially greater static thrust per horsepower input would allow propulsion of aircraft and boats to be attained with substantial savings in energy as compared to that required at present.

BRIEF DESCRIPTION OF THE PRESENT INVENTION

With the foregoing in mind, the present invention contemplates an improved propeller structure so dimensioned as to provide a greater static thrust for a given input horsepower than is realizable with known propellers. More particularly, the dimensioning and geometrical design of the propeller of this invention is such that a substantially constant air discharge is realizable from the roots to the tips of the propeller blades together with a substantial elimination of radial air flow. These desirable results provide for the greater static thrust since energy is not wasted in radial flow. Moreover, the flow pattern lies in a relatively narrow path so that the use of shrouds or ducts as might be required in certain applications is not necessary.

Briefly, the propeller of this invention includes a central imperforate hub and a plurality of blades greater than two having roots and tips connected by straight line leading and trailing edges. The roots are secured to equal circumferentially spaced points on the periphery of the hub, each blade extending radially from its root connection on the hub to its tip a distance equal to one half the diameter of the hub.

Each of the blades is identically dimensioned. Thus, the width of each blade at its root is equal to the spacing measured circumferentially along the periphery of the hub between adjacent blades, the straight leading edge of each blade being normal to a line tangential to the periphery of the hub passing through the point of securement of the root of the blade, the width of the tip of each blade being one-half the width of the root such that the straight trailing edge of each blade defines a tapered blade decreasing uniformly in width from its root to its tip.

The major portion of the cross section of each blade taken along its width dimension has a camber defined by an upper curved line convex when viewed from the top of a first given radius of a curvature and a lower curved line concave when viewed from the bottom of a second given radius of curvature greater than the first given radius of curvature. The angle of attack of the cord of each blade is from 10° to 17°.

BRIEF DESCRIPTION OF THE DRAWINGS

A better understanding of this invention will be had by referring to a preferred embodiment thereof as illustrated in the accompanying drawings in which.

DETAILED DESCRIPTION OF THE PREFERRED EMBODIMENT

Figure 1:
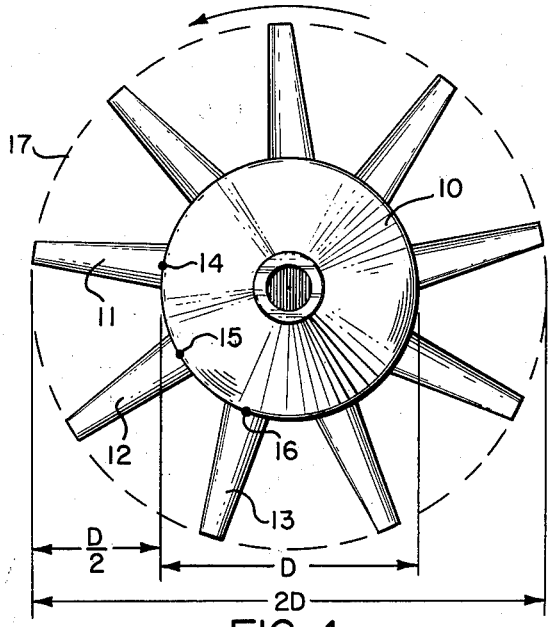
FIG. 1 is a front elevational view of the propeller of this invention.

Referring to FIG. 1 the propeller includes a central imperforate hub 10 having a given hub diameter D. A plurality of propeller blades greater than two are shown, by way of example, at 11, 12 and 13. Preferably, there are provided a total of nine such blades having roots and tips connected by straight line leading and trailing edges, the roots being secured to equal circumferentially spaced points on the periphery of the hub such as 14, 15 and 16. Each blade extends radially from its root connection on the hub to its tip a distance equal to one half the given diameter D, this distance being depicted in FIG. 1 as D/2. As a result, the circular locus swept out by the tips of the various blades indicated in phantom lines at 17 has a diameter equal to 2D.

Figure 2:
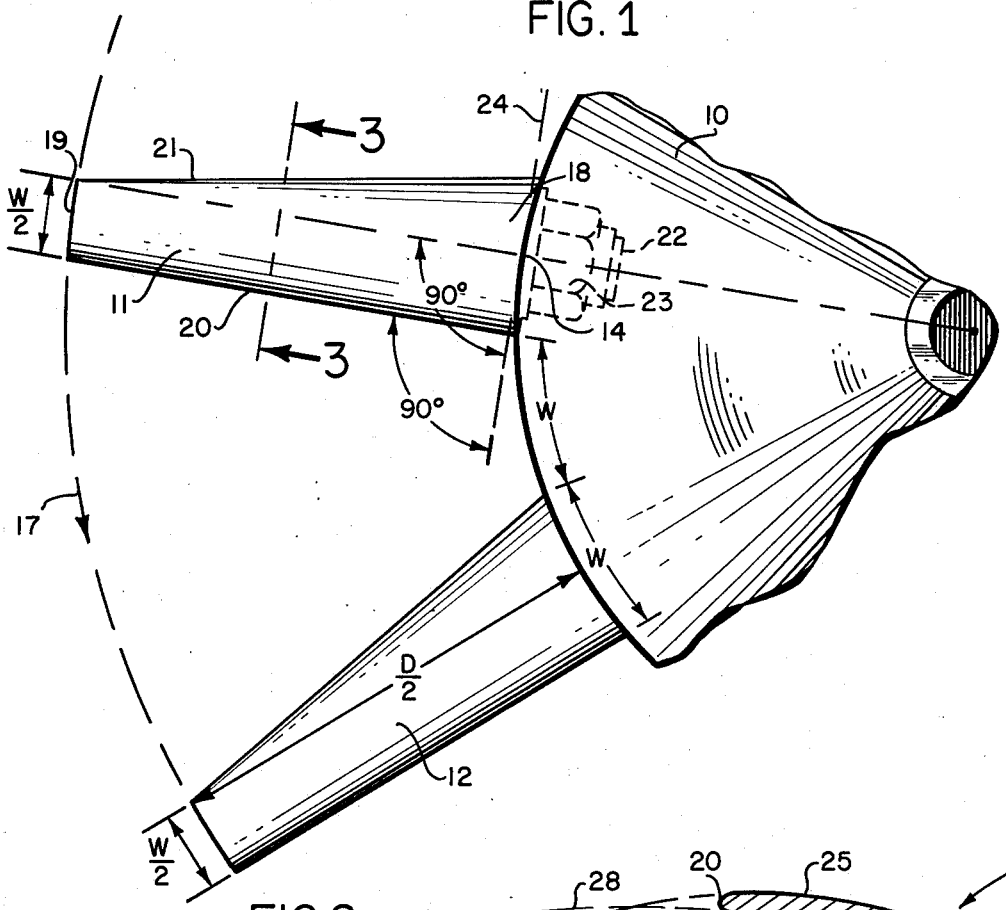
FIG. 2 is a greatly enlarged fragmentary view of two of the blades and a portion of the hub of the propeller illustrated in FIG. 1; and, FIG. 3 is a cross section of one of the propeller blades taken in the direction of the arrows 3—3 of FIG. 2.

Referring to FIG. 2, further details of the blade structures will be evident. Thus, there is depicted for the blade 11 the root portion at 18 and its tip portion at 19. The straight leading edge of the blade 11 is indicated at 20 and the straight trailing edge at 21. The securement of the root 18 to the hub 10 at the point 14 is accomplished by a shank portion 22 shown in phantom lines secured as by a fastening nut 23 within an appropriate cavity as indicated by the phantom lines so that the root 18 of the blade smoothly blends in with the periphery of the hub 10.

It will be noted with reference to the blades 11 and 12 shown in FIG. 2 that the width of each blade at its root designated W for the blade 12 is equal to the spacing circumferentially along the periphery of the hub between the adjacent blades such as the blades 12 and 11. This spacing width is also indicated by the letter W in FIG. 2.

It will also be clear that the straight leading edge such as 20 for the blade 11 of each blade is normal to a line tangential to the periphery of the hub passing through the point of securement of the root of the blade. This tangential line is indicated at 24 for the blade 11 wherein it is tangent to the periphery of the hub 10 at the securement point 14. The 90° relationship of the leading edge 20 is also indicated in FIG. 2 so that in essence the leading edge 20 is parallel to a radial line passing through the securement point 14 from the center of the hub. Necessarily, this radial line forms an angle of 90° with the tangent line 24.

Referring to the tip portion 19 of the blade 11, the width at the tip is one-half the width of the root, this tip dimension being indicated by W/2. By this dimensioning the straight trailing edge of each blade such as indicated at 21 for the blade 11 defines a tapered blade decreasing uniformly in width from its root to its tip.

The significance of the foregoing can now be appreciated. With reference still to FIG. 2, because the length of the blade from the root to the tip designated D/2 is one half the diameter D of the hub 10, the tangential speed of the root portion 18 of the blade 11 when the same is rotating in a counterclockwise direction as depicted in FIGS. 1 and 2 will be one-half the tangential speed of the tip 19 of the blade. In other words, for each complete revolution of the blade, the root portion 18 will travel a distance defined by the circumference of the hub 10 while the tip portion 19 of the blade will travel a distance twice as great defined by the circumference or locus line 17. However, the width at the tip 19 is one-half the width at the root 18. Because of the straight line tapered configuration, it will be evident that the tangential speed of each cross sectional portion of the blade from its root to its tip increases from the root to the tip while the width of the blade decreases from root to tip. The relationship is such that a constant air discharge is provided from the roots to the tips of the blades.

Stated still somewhat differently, the amount of air being moved by the root portion of the blade will be the same as the amount of air being moved by the tip portion of the blade this result being a consequence of the wider width of the blade at the root portion compensating for the slower tangential speed of the root portion and the narrower width of the blade at the tip compensating for the higher tangential speed of the tip. A further consequence of this design is the substantial elimination of any radial air flow thereby avoiding wasted energy which occurs when blades are twisted or so dimensioned as to give rise to radial components of air flow.

Figure 3:
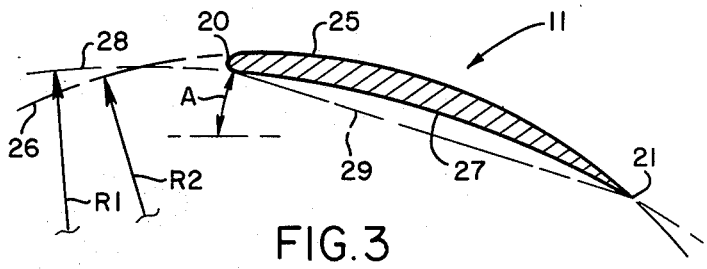

Referring now to FIG. 3, there is illustrated a cross section of the blade 11 at an intermediate point between its root and tip such as provided by viewing the blade 11 in the direction of the arrows 3—3 of FIG. 2. The major portion of this cross section for each blade taken along its width dimension has a camber defined by an upper curved line 25 convex when viewed from the top of a first given radius of curvature R1. The circular arc defining this upper curved line 25 is indicated at 26. The lower portion of the cross section in turn is defined by a lower curved line 27 concave when viewed from the bottom having a second given radius of curvature R2 greater than the first given radius of curvature. This lower curved line 27 constitutes part of the arc of a circle extending in phantom lines shown at 28.

The area enclosed within the circular arcs 26 and 28 between their intersection points defines the cross section of the blade except for a rounding off of the leading edge 20 as shown. This slight rounding of the leading edge avoids a whistle as the blade cuts through the air and also minimizes erosion. The trailing edge 21, in turn, terminates in a sharp edge defined by the intersection point of the arcs.

The blade is oriented such that its cord forms an angle of attack A which may vary from 10° to 17° but in the preferred embodiment is preferably 17°. The angle of attack at the leading edge 20 of the cross section of FIG. 3 is about 6° while the angle of attack of the trailing edge 21 is about 30°. The cord angle of attack remains constant throughout the length of the blade from the root to the tip. In other words, there is no twist to any of the blades. In the preferred embodiment, the ratio of the first radius of curvature R1 of the camber of FIG. 3 to the second radius of curvature is substantially 5 to 9.

In an actual embodiment of the invention, the hub diameter might be about 30 cm. with the length of each of the blades 15 cm. In the preferred embodiment of nine blades the circumferential spacing W between the blades which spacing also defines the width of the root would be about 20° of arc or about 5.2 cm. The tip width would be one-half this value, or about 2.6 cm. With respect to the radii of curvature of the arc portions of the circles defining the chamber of the cross section, and which reference to FIG. 3, R1 would be about 12.7 cm and R2 about 22.8 cm.

From numerous experiments, it has been found that the thrust per input horsepower is markedly increased with the propeller designed in accord with the foregoing, all to the end that a greatly improved propeller structure has been provided by the present invention wherein substantially constant air discharge obtains from the roots to the tips of the blades together with a substantial elimination of radial air flow. This latter feature avoids the necessity of shrouds and cowling and the like in certain applications.

I claim:

1. A propeller including, in combination:

(a) a central imperforate hub having a given hub diameter; and, (b) a plurality of blades greater than two having roots and tips connected by straight line leading and trailing edges, said roots being secured to equal circumferentially spaced points on the periphery of said hub, each blade extending radially from its root connection on the hub to its tip a distance equal to one half said given diameter of the hub so that the circular locus of the blade tips is of a diameter equal to twice the diameter of said hub, and wherein further:

(1) the width of each blade at its root is equal to the spacing measured circumferentially along the periphery of the hub between adjacent blades, (2) the straight leading edge of each blade being normal to a line tangential to the periphery of said hub at the point of securement of the root of the blade, (3) the width of the tip of each blade being one half the width of the root such that the straight trailing edge of each blade defines a tapered blade decreasing uniformly in width from its root to its tip, (4) the major portion of the cross section of each blade taken along its width dimension having a camber defined by an upper curved line convex when viewed from the top of a first given radius of curvature and a lower curved line concave when viewed from the bottom of a second given radius of curvature greater than said first given radius of curvature, and (5) the angle of attack of the cord each blade being uniform from root to tip and having a value from 10° to 17° whereby when said propeller is rotated, a substantially constant air discharge from the roots to the tips of the blades is realized with a substantial elimination of radial air flow.

2. A propeller according to claim 1, in which said angle of attack is 17°.

3. A propeller according to claim 2, in which the ratio of said first radius of curvature of said camber to said second radius of curvature is substantially 5 to 9.

4. A propeller according to claim 3, in which there are provided solely nine blades.

* * * * *